US008460070B2

(12) United States Patent
Boeck et al.

(10) Patent No.: US 8,460,070 B2
(45) Date of Patent: Jun. 11, 2013

(54) GUARD LOCK

(75) Inventors: Cornelius Boeck, Kirchheim (DE); Joachim Schadow, Leinfelden-Echterdingen (DE); Sinisa Andrasic, Schoenaich (DE)

(73) Assignee: Robert Bosch GmbH, Stuttgart (DE)

( * ) Notice: Subject to any disclaimer, the term of this patent is extended or adjusted under 35 U.S.C. 154(b) by 417 days.

(21) Appl. No.: 12/280,850

(22) PCT Filed: Nov. 9, 2007

(86) PCT No.: PCT/EP2007/062108

§ 371 (c)(1),
(2), (4) Date: Aug. 27, 2008

(87) PCT Pub. No.: WO2008/058901

PCT Pub. Date: May 22, 2008

(65) Prior Publication Data

US 2009/0036044 A1 Feb. 5, 2009

(30) Foreign Application Priority Data

Nov. 13, 2006 (DE) ..... 10 2006 053 305

(51) Int. Cl.
*B24B 55/04* (2006.01)

(52) U.S. Cl.
USPC ..... 451/451; 451/359; 451/452; 451/453

(58) Field of Classification Search
USPC ..... 451/344, 353, 359, 451, 452, 453
See application file for complete search history.

(56) References Cited

U.S. PATENT DOCUMENTS

| | | | | |
|---|---|---|---|---|
| 2,384,243 | A | 9/1945 | Flohr et al. | |
| 4,060,940 | A * | 12/1977 | DeWitt | 451/358 |
| 4,574,532 | A * | 3/1986 | Haberle et al. | 451/451 |
| 4,791,541 | A * | 12/1988 | Simmons | 362/376 |
| 4,924,635 | A * | 5/1990 | Rudolf et al. | 451/344 |
| 5,005,321 | A * | 4/1991 | Barth et al. | 451/359 |
| 5,167,215 | A * | 12/1992 | Harding, Jr. | 125/13.01 |
| 5,384,985 | A * | 1/1995 | Jacobsson | 451/344 |
| 5,440,815 | A * | 8/1995 | Inkster | 30/390 |
| 5,766,062 | A * | 6/1998 | Edling | 451/451 |
| 6,464,573 | B1 * | 10/2002 | Keller | 451/451 |
| 6,669,544 | B1 * | 12/2003 | Walz et al. | 451/454 |
| 6,699,114 | B1 * | 3/2004 | Booeshaghi et al. | 451/451 |
| 6,893,334 | B1 * | 5/2005 | Stivers | 451/359 |
| 6,949,017 | B2 * | 9/2005 | Koschel et al. | 451/358 |
| 6,988,939 | B2 * | 1/2006 | Hofmann et al. | 451/344 |
| 7,063,606 | B2 * | 6/2006 | Stierle et al. | 451/359 |

(Continued)

FOREIGN PATENT DOCUMENTS

| | | |
|---|---|---|
| CN | 2080440 | 7/1991 |
| DE | 103 43 060 | 4/2005 |

(Continued)

*Primary Examiner* — Eileen P. Morgan
(74) *Attorney, Agent, or Firm* — Michael J. Striker

(57) ABSTRACT

The invention relates to a protective hood securing device for a portable power tool (12), especially an angle grinder. Said protective hood securing device comprises a protective hood unit (14), having a protective hood (16), and a securing unit (18) having at least one securing element (20) which is provided together with the protective hood unit (14) for protection in the event of a tool (22) breakage. For this purpose, the securing element (20) is at least partially configured by a protective cover (24) that is provided in addition to the protective hood (16).

25 Claims, 4 Drawing Sheets

U.S. PATENT DOCUMENTS

Figure 1:
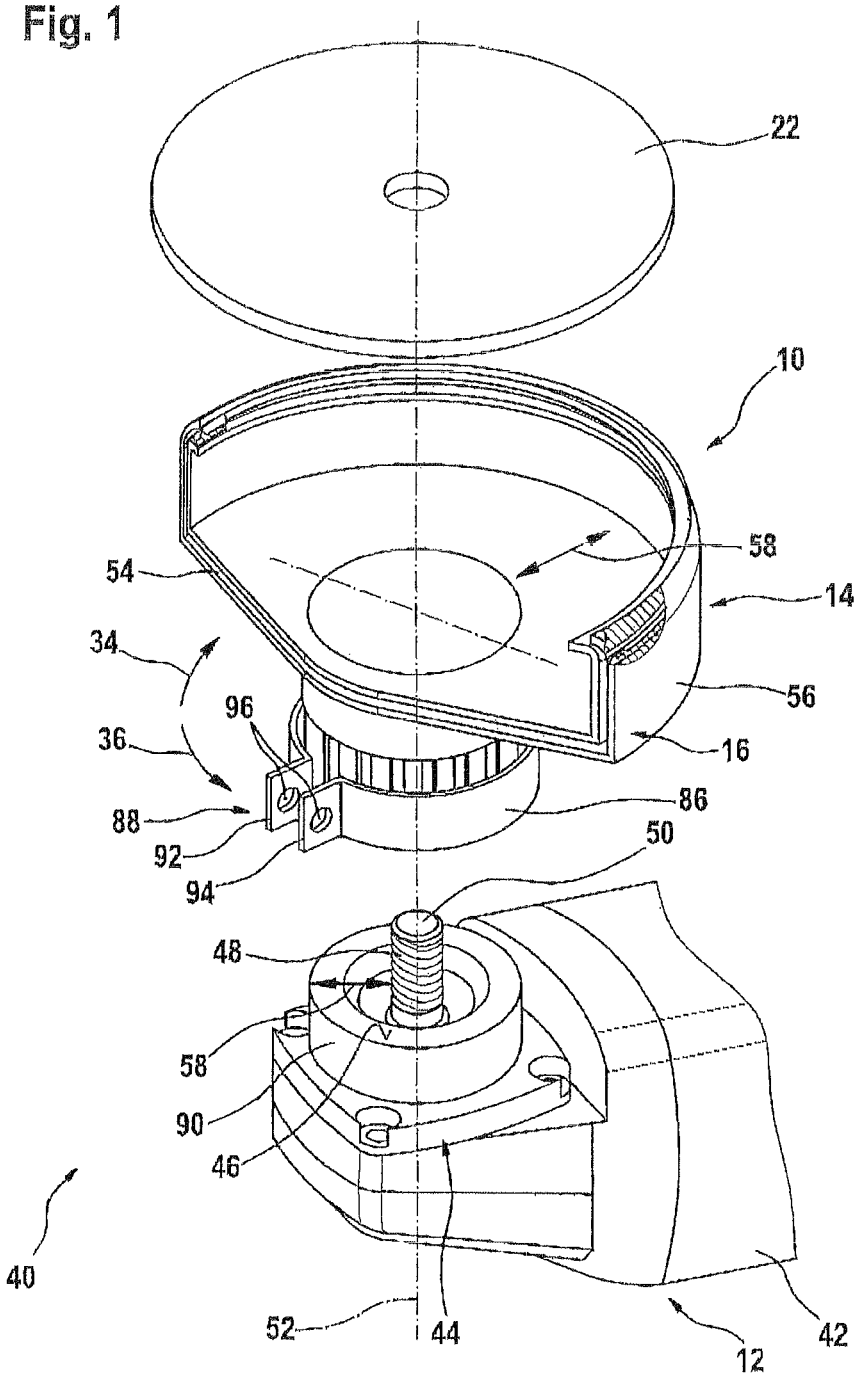

| | | | | |
|---|---|---|---|---|
| 7,311,589 | B2 * | 12/2007 | Wiker | 451/451 |
| 7,438,633 | B2 * | 10/2008 | Jespersen | 451/350 |
| 7,524,239 | B2 * | 4/2009 | Schmidberger-Brinek et al. | 451/451 |
| 2002/0157265 | A1 * | 10/2002 | Haneda et al. | 30/391 |
| 2004/0014412 | A1 * | 1/2004 | Hofmann et al. | 451/451 |
| 2006/0052041 | A1 * | 3/2006 | Wiker | 451/451 |

FOREIGN PATENT DOCUMENTS

| | | |
|---|---|---|
| EP | 0 812 657 | 12/1997 |
| SU | 56992 | 4/1940 |
| SU | 301270 | 6/1971 |
| SU | 1111855 | 9/1984 |
| SU | 1121131 | 10/1984 |
| WO | 86/04855 | 8/1986 |

* cited by examiner

GUARD LOCK

RELATED ART

The present invention is directed to a guard securing device according to the preamble of Claim 1.

An angle grinder with an adjustable guard is made known in EP 812 657 A1. In that case, the guard is adjustable in a rotating manner on a connection piece of a flange of the angle grinder, and is supported such that it may be detachably attached using a single form-fit locking means. The spindle of the angle grinder passes through the center of the flange. A cutting disk and/or grinding disk are/is installed on the free end of the spindle in a clampable, rotationally drivable manner for cutting and machining work pieces, which are partially enclosed by the guard. The guard must be positioned in a rotationally adjustable manner on the hand-held power tool such that the region of the grinding disk that faces the user is enclosed by the guard. At the same time, a region of the grinding disk that points away from the user extends past the flange, radially relative to the work piece engagement.

ADVANTAGES OF THE INVENTION

The present invention is directed to a guard securing device for a hand-held power tool, in particular for an angle grinder, with a guard unit that includes a guard, and a securing unit with at least one securing element, which is provided together with the guard unit to ensure protection if a tool should break.

It is provided that the securing element is designed at least partially as a protective cover that is provided in addition to the guard. The guard unit is preferably provided to protect an operator—during regular operation of the hand-held power tool—from a tool, in particular from a disk-shaped, rotatably drivable tool, and/or from machining residue that is slung in the direction of the operator, and it is attached to the hand-held power tool in a working position. In addition, a "protective cover" refers, in particular, to a cover that, in addition to the guard, covers at least a portion of a region—which is provided to accommodate the tool—if a tool should break. To this end, the protective cover and the guard are designed to protect the operator by absorbing forces of an outwardly-slung piece of a tool that has burst during operation of the hand-held power tool. Due to the inventive design of the guard anti-rotation lock, it is possible to effectively protect an operator of the hand-held power tool from a tool that rotates during operation of the hand-held power tool, and, in particular, from pieces of the tool that are slung in the direction of the operator if the tool becomes damaged, e.g., if the tool should burst. Particularly advantageously, the protective cover extends around an angular range of the tool of at least 30°, preferably at least 90°, and particularly advantageously essentially 180°, thereby making it possible to cover the tool essentially completely together with the guard if a tool should burst. "Essentially 180°" refers, in particular, to coverage of an angular range of the tool of 180°±10%. The securing unit and/or the protective cover of the securing unit may also be composed of several securing elements, which are preferably located one after the other in a circumferential direction and/or in a rotational direction of the tool inside the securing unit, e.g., two securing elements, each of which covers an angular range of the tool of approximately 90°, and/or the individual securing elements may be designed as lamella, and/or other embodiments of the securing elements that appear reasonable to one skilled in the technical art are also feasible.

It is further proposed that the securing element is supported at least partially on the guard, thereby making it possible to position the protective cover in a particularly compact and space-saving manner. Particularly advantageously, a shape and/or contour of the securing element is designed to at least partially match a shape and/or contour of the guard. In this context, "supported on the guard" means, in particular, that the protective cover includes at least one contact point—preferably a contact surface—with the guard, and/or it includes at least one overlap region with the guard, and/or that a further component—a bearing component, in particular—may be in contact with the guard.

If the protective cover is also located such that it may rotate—at least partially—relative to the guard, it is possible to advantageously move or rotate the protective cover into a protective position if a tool should burst, and it is possible to provide an operator with an advantageous view of an object to be machined during regular operation of the hand-held power tool, in that the protective cover is advantageously supported in a neutral position at least partially inside the guard unit, in particular in the guard. Preferably, the protective cover is located in a neutral position inside the guard securing device and/or the guard unit during regular operation of a hand-held power tool and/or in a switched-off operating mode of the hand-held power tool.

If, in addition, the protective cover is located at least partially on a side of the guard facing a tool, a space-saving configuration may be advantageously attained, and/or it is advantageously possible for a pulse and/or the kinetic energy of an outwardly slung tool piece that strikes the protective cover to result in a motion and/or rotation of the guard from a neutral position into a protective position. "Located on the guard" is intended to mean, in particular, that the protective cover serves as an installation unit with the guard when the guard unit is installed with the hand-held power tool.

In an advantageous refinement of the present invention, it is provided that the guard securing device includes at least one guide element, which is provided for the movable support of the protective cover, thereby making it possible to move and/or rotate the protective cover from a neutral position and into a protective position in a targeted manner, in order to protect the operator from a bursting tool.

It is also provided that the guide element is designed at least partially as a single piece with the guard unit, thereby making it advantageously possible to eliminate further components, installation space, installation effort and costs.

It is also provided that the guard unit includes a guard collar that encloses a receiving region for a hand-held power tool by at least 270° in a circumferential direction, thereby making it possible to advantageously attach the guard unit to the hand-held power tool if a tool should burst.

In addition, an at least partially captive guidance of the protective cover in a circumferential direction may be attained when the guard collar is formed at least partially by the guide element.

It is furthermore provided that the guard collar is at least partially stepped in design, thereby making it possible to attain an advantageous and, in particular, captive attachment of the guard unit and/or the guard to the hand-held power tool in a first stage, while simultaneously making it possible, in a second stage, to guide the protective cover during a motion and/or rotation into a protective position using the guard collar.

It is possible to reliably position the protective cover in a protective position and, therefore, in a particularly advantageous protective position of the guard unit if a tool should burst that protects an operator from tool pieces that are slung in the direction of the operator if the tool should burst when the guard includes a receiving region for a tool, and when the protective cover—in a protective position and together with the guard—covers an angular range of at least 235°, preferably at least 270°, and particularly preferably essentially 360° of the receiving region. The expression "essentially 360°" refers, in particular, to an angular range of the receiving region of 320° to 360°.

Particularly advantageously, the present invention includes a hand-held power tool for a rotating, preferably disk-shaped tool, with a hand-held power tool housing that includes a flange and/or a machine neck, on which a guard—that is composed of sheet metal in particular—is detachably clampable in order to cover the tool. The guard includes a guard body, which is composed of a circular, disk-shaped piece, in particular with an outer edge located at a right angle thereto, and with a central, circular recess, on the edge of which a guard connection piece and/or collar is formed and that includes an annular clamping band that may be tightened using a clamping means. An anti-rotation lock that acts between the machine neck and the guard is located between the guard and the machine neck and is designed as a profiled structure. The guard may be repeatedly coupled via the clamping band and/or the clamping means in its clamping position in a form-fit and/or non-positive manner with the machine neck, and is therefore capable of being fixed in a non-rotatable position and, to attain a release position, may be disengaged from the form-fit and/or non-positive connection, so that the guard may then be adjusted in a rotational manner.

DRAWING

Further advantages result from the description of the drawing, below. Exemplary embodiments of the present invention are shown in the drawing. The drawing, the description, and the claims contain numerous features in combination. One skilled in the art will also advantageously consider the features individually and combine them to form further reasonable combinations.

Figure 2:
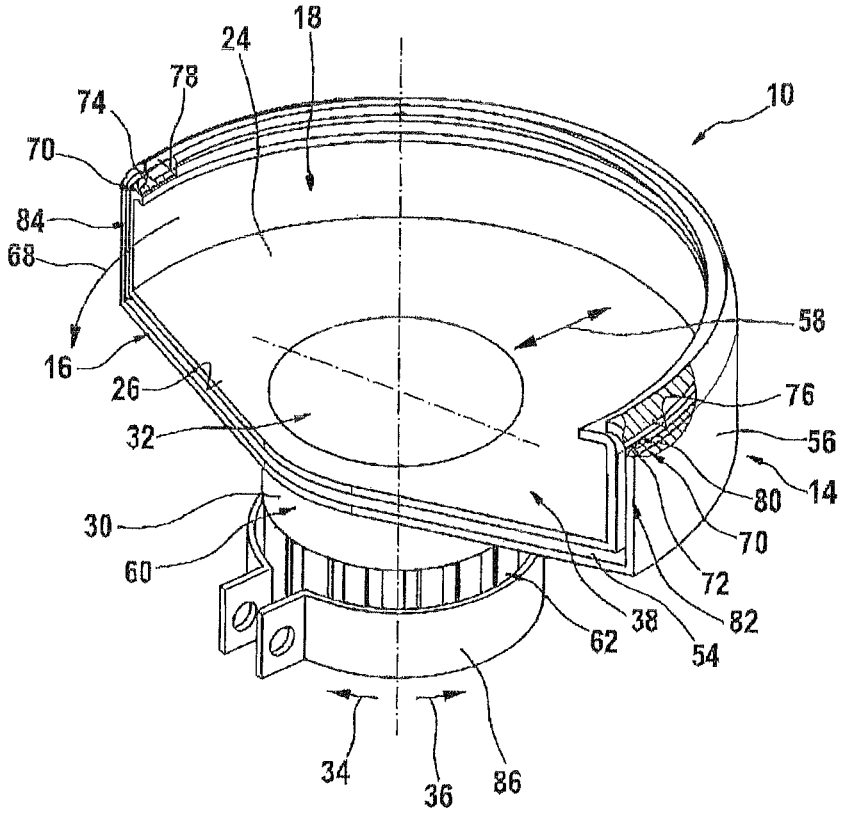
Figure 2A:
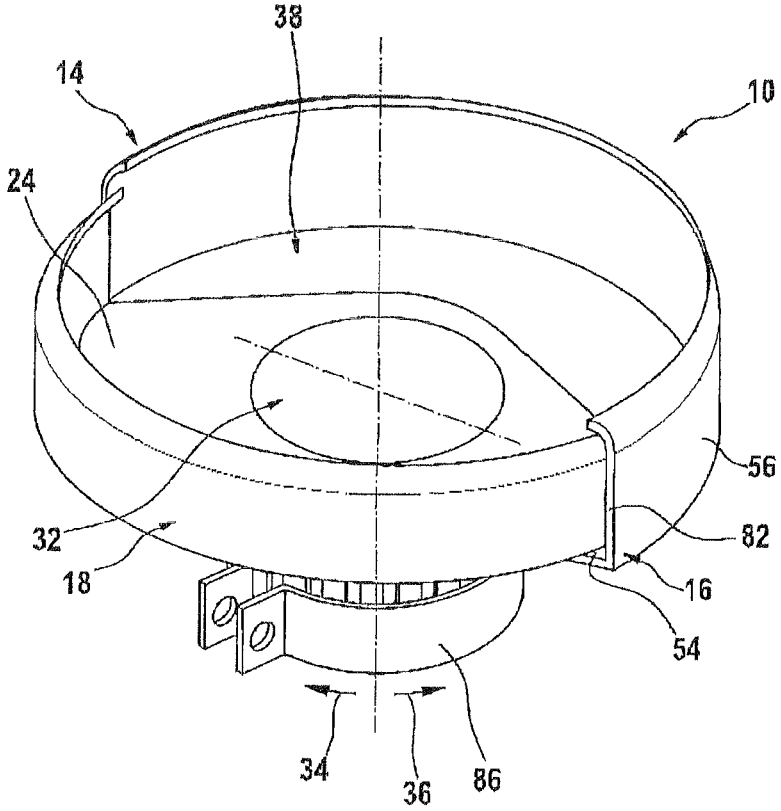
Figure 3:
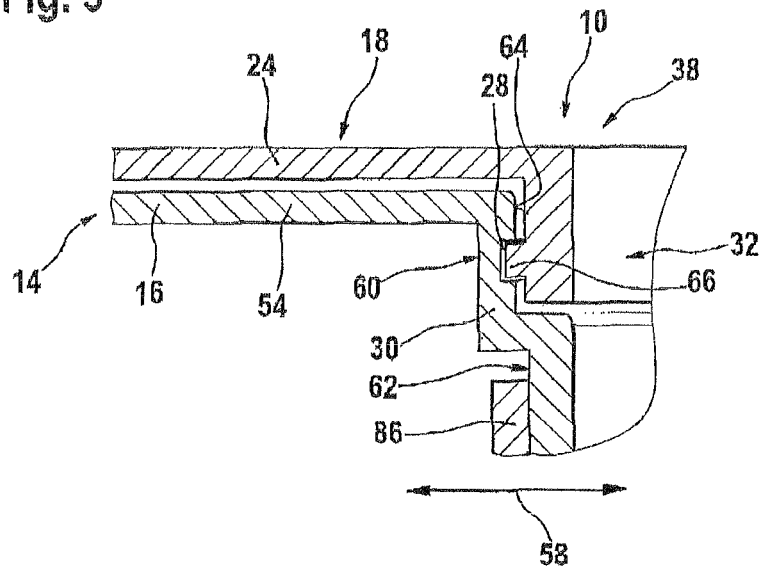
Figure 4:
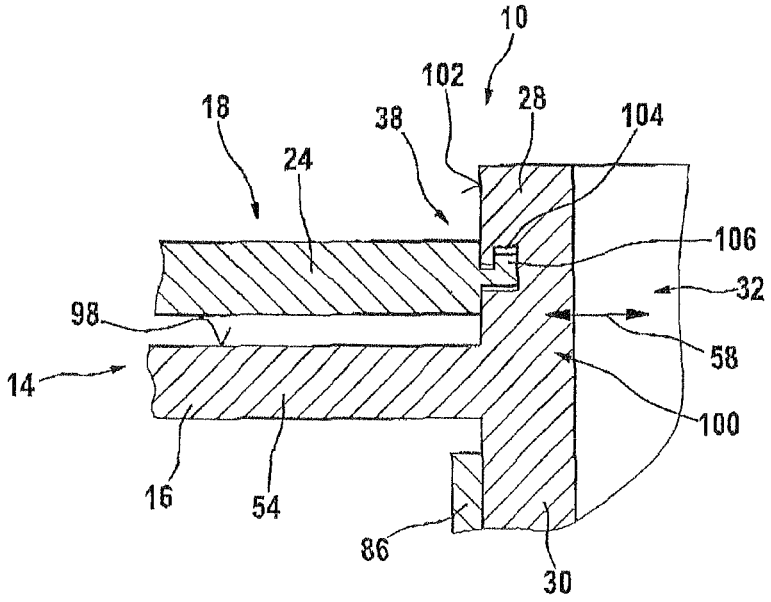

FIG. 1 shows an exploded view of a hand-held power tool with an inventive guard securing device, FIG. 2 shows the guard securing device in a perspective view, FIG. 2A shows the guard securing device in a perspective view highlighting the protective cover 24 after rotation, FIG. 3 shows the guard securing device in a cross-sectional view, and FIG. 4 shows an embodiment of the guard securing device that is an alternative to that shown in FIG. 3, in a cross-sectional view.

DESCRIPTION OF THE EXEMPLARY EMBODIMENTS

FIG. 1 shows a hand-held power tool system 40 with a hand-held power tool 12 designed as an angle grinder and shown only partially here, and a guard securing device 10 with a guard unit 14. Hand-held power tool 12 includes a hand-held power tool housing 42, and a receiving unit 44 for receiving guard unit 14 or a tool 22 designed as a cutting disk, receiving unit 44 being screwed together with hand-held power tool housing 42. A drive shaft 48 extends out of receiving unit 44 on a side 46 facing away from hand-held power tool housing 42. Drive shaft 48 is connectable at its free end 50 with disk-shaped tool 22 and is rotationally drivable around an axis 52. Guard unit 14 includes a guard 16 and a closing unit 88. In an installed state of hand-held power tool system 40, guard 16 extends around an angular range of tool 22 of approximately 180° and, to this end, includes a semi-disk shaped guard body 54 and a guard edge 56, which is initially oriented perpendicularly to semi-disk shaped body 54 and is finally oriented parallel to semi-disk shaped guard body 54, inwardly in a radial direction 58.

Guard securing device 10 includes—in addition to guard unit 14—a securing unit 18 with a securing element 20, which is provided together with guard unit 14 or its guard 16 to provide protection if tool 22 should burst. Protective cover 24 is provided in addition to guard 16 and covers an angular range of approximately 180° of tool 22. Protective cover 24 is supported on guard 16 and, to this end, has the same shape or contour of guard 16. Guard 16 includes a receiving region 38 for accommodating tool 22. Protective cover 24 is supported on guard 16 inside receiving region 38 or on a side 26 of receiving region 38 facing tool 22. Guard 16 therefore serves as an outer sleeve for protective cover 24, and protective cover 24 serves as an inner sleeve for guard 16. In a neutral position or in a position during regular operation of hand-held power tool 12, protective cover 24 is located on guard 16 such that protective cover 24 overlaps guard 16 nearly completely (FIGS. 1, 2 and 2A).

In addition, protective cover 24 is movably supported on guard 16, so that, if tool 22 should burst, protective cover 24 may absorb a pulse of a piece of burst tool 22 that strikes guard unit 14 or protective cover 24, and protective cover 24 may then be moved into a protective position via the pulse. To this end, guard unit 14 or guard 16 includes a guard collar 30 that encloses a receiving region 32 for accommodating hand-held power tool 12 or receiving unit 44 by 360° in a circumferential direction 34, 36 (FIGS. 1, 2 and 2A). Circumferential direction 34, 36 extends around axis 52 of drive shaft 48 and is oriented essentially perpendicularly thereto. Guard collar 30 is designed stepped along axis 52 and has—in a subregion 60 that faces tool 22 or receiving region 38 for tool—a larger cross-section than a cross-sectional area in a subregion 62 that faces away from tool 22 or receiving region 38 for tool 22 (see FIG. 3). Subregion 60 with the larger cross-sectional area includes a guide element 28 of guard securing device 14 on a side 64 facing receiving region 32 for hand-held power tool 12, guide element 28 being designed as a single piece with guard collar 30. Guide element 28 is provided to ensure that protective cover 24 is movably supported in guard unit 14, and it is designed as a circumferential guide groove that extends outwardly in a radial direction 58. Protective cover 24 is located such that it may rotate around axis 52 of drive shaft 48 relative to guard 16 and, to this end, includes guide elements, each of which is designed as a guide segment 66, and which are supported in the guide groove. Only one guide segment 66 is shown in FIG. 3. As a result, protective cover 24 is secured against accidentally falling out of guard unit 14 when it moves into a protective position or during operation of hand-held power tool 12.

FIG. 2A shows the protective cover 24 in a protective position after the protective cover has been rotated approximately 180° with respect to guard 16 or guard central axis.

To secure protective cover 24—during regular operation—in a neutral position and/or in a position in which it overlaps guard 16 nearly completely, guard securing device 10 includes a not-shown securing unit, which prevents protective cover 24 from accidentally moving into a protective position during regular operation of hand-held power tool 12. The securing unit allows protective cover 24 to move in a rotational direction 68 of tool 22 depending on a pulse that is transferred to protective cover 24. If tool 22 should burst and an outwardly slung tool piece strikes guard unit 14 or protective cover 24, a pulse that is transferred to protective cover 24 exceeds a securing force of securing unit 18, and protective cover 24 is rotated in rotational direction 68 out of its neutral position and into the protective position.

When protective cover 24 and guard 16 are in a protective position, protective cover 24 and guard 16 extend around an entire angular range of receiving region 38 of tool 22 of 360°. To prevent protective cover 24—which is in the protective position—from rotating further in rotation direction 68 of tool 22, guard securing device 10 includes a stop unit 70, which stops a rotation of protective cover 24 in rotation direction 68 after the protective position has been reached. Stop unit 70 includes two stop elements, each of which is designed as a detent element 72, 74, one of which is located on a radially inwardly oriented side 76 of guard edge 56, and the other of which is located on a side 78 of protective cover 24 that faces guard edge 56. Guard edge 56 also includes—downstream of detent element 72 in rotational direction 68—a stop element 80. Stop element 80 and detent element 72 are located in an edge region 82 of guard edge 56 that points in the direction opposite to rotational direction 68. Detent element 74 of protective cover 24 is located on an edge region 84 that points in rotational direction 68. A rotational motion of protective cover 24 is stopped in rotational direction 68 via stop element 80, and it is prevented from rotating back into the neutral position due to a return pulse via both detent elements 72, 74.

Subregion 62 of guard collar 30 with the smaller cross-sectional area is enclosed outwardly in radial direction 58 by a clamping band 86 of closing unit 88. Guard collar 30 and clamping band 86 are interconnected via a welded connection (FIGS. 1 through 3). Guard collar 30—together with clamping band 86—is provided to attach guard unit 14 to hand-held power tool 12 or to receiving unit 44, which includes a cylindrical receiving flange 90 for this purpose. In addition, subregion 62 with the smaller cross-sectional area is designed slotted along axis 52 of drive shaft 48, thereby making it possible to effectively reduce a cross-sectional area using clamping band 86 to obtain a non-positive connection between guard collar 30 on receiving flange 90. Clamping band 86 also includes two end regions 92, 94, which extend outwardly in radial direction 58. End regions 92, 94 each include a recess 96, through which a closing element—which is designed as a clamping screw and is not shown—of closing unit 88 extends (see FIG. 1). Guard 16 is attached to receiving unit 44 or and/or on receiving flange 90 in a working position via closing unit 88 using a frictional connection between guard collar 30 or clamping band 86 and receiving flange 90. In an alternative design of closing unit 88, it is basically feasible to use—instead of the clamping screw—further closing elements, e.g., a clamping lever or form-fit elements, etc.

FIG. 4 shows an alternative embodiment of guard securing device 10 with a guard unit 14. Guard unit 14 includes a guard 16 with a guard collar 30, which has a cross-sectional area that remains the same along an axis of a drive shaft. On a side 98 facing a receiving region 38 of a tool, guard 16 includes a guide element 28 that serves to guide a protective cover 24 of a securing unit 18. Guide element 28 is located on an edge region 100 of a guard body 54 of guard 16 that faces receiving region 38, and it extends along the axis of the drive shaft. Guide element 28 is annular in design and includes a guide groove 104 on a side 102 that points outwardly in radial direction 58, in which protective cover 24 is movably supported or in which a guide element 106 of protective cover 24 is guided. Guide element 106 and guide groove 104 are L-shaped in design. Protective cover 24 is therefore protected from falling out when it is rotated into a protective position or during operation of a hand-held power tool.

In an alternative and not-shown embodiment of guard securing device 10, it is also feasible for securing unit 18 or protective cover 24 to be designed as several securing elements, which are located, e.g., one after the other in the circumferential direction, or as a collapsible securing element, the securing elements being movably supported on guard 16. The securing elements or the securing element may be moved into the protective position via a pulse of a piece of burst tool 22 that strikes protective cover 24. Securing elements are also preferably interconnected using a driving element, so that, when a pulse is transferred from a piece of a burst tool 22 to a securing element, all securing elements of securing unit 18 may be moved into the protective position.

What is claimed is:

1. An angle grinder with a tool rotatably drivable about an axis, a guard device comprising a guard fixedly connectable to the hand-held power tool, said guard extending over a first angular range around a guard axis which is arranged to substantially coincide with the axis of rotation of the tool so as to cover at least a part of the tool to protect a user;

a protective cover extendable over a second angular range around said guard axis and rotatable relative to said guard about said guard axis, so that in one position said protective cover is located within said guard substantially in a same angular region, and when rotated relative to the guard, said protective cover is located in another, circumferentially neighboring angular region so as to cover jointly with said guard a greater angular range than said first angular range; and guide means for guiding said protective cover during its rotation relative to said guard and including respective guiding elements on said protective cover and on said guard that interact with one another during the rotation of the protective cover relative to said guard to guide the protective cover;

wherein said protective cover is mounted rotatably on said guard so that if the tool breaks during operation and if a piece from the broken tool strikes said protective cover, said protective cover rotates relative said guard; and wherein said protective cover and said guard device extend around an entire angular range of the tool of 360° when in a protective position.

2. The guard device as defined in claim 1, wherein said protective cover extends over said second angular range of at least 90° beyond said first angular range.

3. The guard device as defined in claim 1, wherein said protective cover extends over said second angular range of at least 180° beyond said first angular range.

4. The guard device as defined in claim 1, wherein said protective cover is at least partially supported on said guard.

5. The guard device as defined in claim 4, wherein said protective cover is supported on said guard rotatably relative to said guard.

6. The guard device as defined in claim 3, wherein said protective cover is located partially on a side of said guard that is arranged to face the tool.

7. The guard device as defined in claim 5, further comprising at least one guide element rotatably supporting said protective cover on said guard.

8. The guard device as defined in claim 7, wherein said guide element is at least partially a single piece with said guard.

9. The guard device as defined in claim 7, wherein said guard includes a guard collar enclosing a receiving region for the tool and extending by at least 270° in the circumferential direction about said guard axis.

10. The guard device as defined in claim 9, wherein said guard collar is formed at least partially by said guide element.

11. The guard device as defined in claim 9, wherein said guard collar is at least partially stepped.

12. The guard device as defined in claim 1, wherein said guard together with said protective cover in said another position cover the greater angular range of at least 235° relative said guard axis.

13. The guard device as defined in claim 1, wherein said guide means includes a guiding segment and a guiding groove.

14. The guard device as defined in claim 13, wherein said guiding segment is located in said protective cover and said guiding groove is located in said guard.

15. The guard device as defined in claim 1, wherein said guard has a semi-disk shaped guard body extending radially from the guard axis to an edge region, the edge region extending in a direction perpendicular to the extent of the guard body and ending in an inner edge, the inner edge extending in an inwardly radial direction in parallel to the extent of the guard body.

16. The guard device as defined in claim 15, wherein said protective cover has a semi-disk shaped guard body extending radially from the guard axis to an edge region, the edge region extending in a direction perpendicular to the extent of the guard body and ending in an inner edge, the inner edge extending in an inwardly radial direction in parallel to the extent of the guard body.

17. The guard device as defined in claim 16, wherein said edge region of said guard and said edge region of said protective cover are arranged in an axial direction one upon another.

18. A guard device for a angle grinder having a tool rotatably driveable about an axis of rotation, the guard device comprising a guard fixedly connectable to the hand-held power tool and extending over a first angular range around a guard axis, which is arranged to substantially coincide with the axis of rotation of the tool, to cover at least a part of the tool to protect a user;

a protective cover extendable over a second angular range around said guard axis and rotatable within and relative to said guard about said guard axis and the axis of rotation of the tool; and guide means for guiding the protective cover during its rotation relative to said guard and including respective guiding elements on the protective cover and on said guard that interact with one another during the rotation of the protective cover relative to said guard to guide the protective cover;

wherein the protective cover is configured so that in case the tool should break into pieces that are outwardly slung, and one of the pieces of the tool strikes said protective cover, said protective cover absorbs forces imparted by the striking piece of the tool and rotates by said guide means relative to the guard according to the imparted forces to cover jointly with said guard a greater angular area of the tool than covered separately by the guard and to protect a user thereby; and wherein said protective cover and said guard device extend around an entire angular range of the tool of 360° when in a protective position.

19. A guard device as defined in claim 18, wherein said guide means includes a guiding segment and a guiding groove.

20. A guard device for a angle grinder having a tool rotatably drivable about an axis, the guard device comprising a guard fixedly connectable to the hand-held power tool, the guard extending over a first angular range around a guard axis which is arranged to substantially coincide with the axis of rotation of the tool so as to cover at least a part of the tool to protect a user;

a protective cover extendable over a second angular range around the guard axis and rotatable relative to the guard about the guard axis, so that in one position the protective cover is located within the guard substantially in a same angular region, and when rotated relative to the guard, the protective cover is located in another, circumferentially neighboring angular region so as to cover jointly with the guard a greater angular range than the first angular range; and guide means for guiding the protective cover during its rotation relative to the guard and including respective guiding elements on the protective cover and on the guard that interact with one another during the rotation of the protective cover relative to the guard to guide the protective cover;

wherein the protective cover is configured so that in case the tool should break into pieces that are outwardly slung, and one of the pieces of the tool strikes the protective cover, the protective cover absorbs forces imparted by the striking piece and rotates by the guide means relative to the guard according to the imparted forces to cover jointly with the guard the greater angular ranges and to protect a user thereby; and wherein said protective cover and said guard device extend around an entire angular range of the tool of 360° when in a protective position.

21. A guard device as defined in claim 20, wherein said guide means includes a guiding segment and a guiding groove.

22. The guard device as defined in claim 21, further comprising a stop unit configured to prevent said protective cover from rotating further beyond the protective position in a rotational direction of the tool, after the protective position has been reached.

23. The guard device as defined in claim 22, wherein the stop unit comprises two stop elements.

24. The guard device as defined in claim 23, wherein one of the stop elements is located on a guard edge and the other stop element is located on a side of the protective cover that faces the guard edge.

25. A guard device for a angle grinder having a tool rotatably drivable about an axis, the guard device comprising a guard fixedly connectable to the hand-held power tool, said guard extending over a first angular range around a guard axis which is arranged to substantially coincide with the axis of rotation of the tool so as to cover at least a part of the tool to protect a user;

a protective cover extendable over a second angular range around said guard axis and rotatable relative to said guard about said guard axis, so that in one position said protective cover is located within said guard substantially in a same angular region, and when rotated relative to the guard, said protective cover is located in another, circumferentially neighboring angular region so as to cover jointly with said guard a greater angular range than said first angular range;

guide means for guiding said protective cover during its rotation relative to said guard and including respective guiding elements on said protective cover and on said guard that interact with one another during the rotation of the protective cover relative to said guard to guide the protective cover; and a securing unit providing a securing force to prevent the protective cover from rotating from said one position unless acted upon by a force that exceeds said securing force;

wherein said protective cover is mounted rotatably on said guard using said securing unit so that if the tool breaks during operation, and if a piece from the broken tool strikes said protective cover and imparts to the protective cover a striking force that exceeds the securing force, said protective cover rotates relative said guard and guided by said guiding means to cover jointly with said guard the greater angular range than said first angular range; and wherein said protective cover and said guard device extend around an entire angular range of the tool of 360° when in a protective position.

* * * * *